US006487940B2

(12) United States Patent
Hart et al.

(10) Patent No.: US 6,487,940 B2
(45) Date of Patent: Dec. 3, 2002

(54) NUT DRIVER

(75) Inventors: David P. Hart, Queen City, MO (US); Roger L. Smith, Keokuk, IA (US); George R. Pearl, Jr., Canton, MO (US); John W. Moander, Keokuk, IA (US)

(73) Assignee: Associated Toolmakers Incorporated, Keokuk, IA (US)

( * ) Notice: Subject to any disclaimer, the term of this patent is extended or adjusted under 35 U.S.C. 154(b) by 0 days.

(21) Appl. No.: 09/767,537

(22) Filed: Jan. 23, 2001

(65) Prior Publication Data

US 2002/0096020 A1 Jul. 25, 2002

(51) Int. Cl.[7] ..... B25B 21/00
(52) U.S. Cl. ..... 81/57.14; 81/55; 81/56
(58) Field of Search ..... 81/55, 56, 57.14, 81/57.3, 57.31

(56) References Cited

U.S. PATENT DOCUMENTS

| | | | | |
|---|---|---|---|---|
| 2,537,382 A | * | 1/1951 | Valentin | 81/56 |
| 2,882,773 A | * | 4/1959 | Wing | 81/56 |
| 3,331,269 A | * | 7/1967 | Sauter | 81/56 X |
| 3,916,734 A | * | 11/1975 | Sawan | 81/55 X |
| 4,231,270 A | | 11/1980 | Totsu | |
| 4,320,674 A | | 3/1982 | Ito et al. | |
| 4,467,877 A | | 8/1984 | Koltermann et al. | |
| 4,544,039 A | | 10/1985 | Crane | |
| 4,554,980 A | | 11/1985 | Doniwa | |
| 4,606,443 A | | 8/1986 | Kimura | |
| 4,646,592 A | | 3/1987 | Jones | |
| 4,836,296 A | | 6/1989 | Biek | |
| 4,838,133 A | | 6/1989 | Dainin | |
| 4,846,027 A | | 7/1989 | Lu | |
| 4,862,773 A | * | 9/1989 | Batten | 81/55 |
| 4,869,139 A | | 9/1989 | Gotman | |
| 4,875,528 A | | 10/1989 | Thackston | |
| 4,880,064 A | | 11/1989 | Willoughby et al. | |
| 4,923,047 A | | 5/1990 | Fink et al. | |
| 4,936,395 A | | 6/1990 | Enderle | |
| 5,005,682 A | | 4/1991 | Young et al. | |
| 5,054,588 A | | 10/1991 | Thorp et al. | |
| 5,060,771 A | | 10/1991 | Robinson | |
| 5,161,437 A | | 11/1992 | Yasutomi et al. | |
| 5,176,047 A | | 1/1993 | Bai et al. | |
| 5,277,085 A | | 1/1994 | Tanimura et al. | |
| 5,339,908 A | | 8/1994 | Yokota et al. | |
| 5,412,546 A | | 5/1995 | Huang | |
| 5,490,439 A | | 2/1996 | Matsumura et al. | |
| 5,538,089 A | | 7/1996 | Sanford | |
| 5,540,629 A | | 7/1996 | Gotman | |
| 5,544,553 A | | 8/1996 | Galat | |
| 5,553,519 A | | 9/1996 | Pettit, Jr. | |
| 5,558,168 A | | 9/1996 | Rahm | |
| 5,582,079 A | | 12/1996 | Matsumura et al. | |
| 5,692,575 A | | 12/1997 | Hellstrom | |
| 5,706,902 A | | 1/1998 | Eisenhardt | |
| 5,813,478 A | | 9/1998 | Kettner | |
| 5,953,965 A | * | 9/1999 | Kaneyama et al. | 81/55 |
| 5,954,144 A | | 9/1999 | Thames | |
| 5,992,538 A | | 11/1999 | Marcengill et al. | |

OTHER PUBLICATIONS

Aimco—Assembly Tool Catalog (Apr. 1999), entire catalog.

* cited by examiner

*Primary Examiner*—James G. Smith
(74) *Attorney, Agent, or Firm*—Harness, Dickey & Pierce, P.L.C.

(57) ABSTRACT

A nut driver is provided in which a torque is delivered to a fastener while a bolt is rotationally maintained in a fixed position thereby tightening the fastener onto the bolt. The nut driver also removably attaches to pulse gun and includes a planetary gear arrangement. The nut driver is interchangeable with a variety of pulse guns. Although, conventional devices provide a torque to rotationally couple a nut to a bolt, the feature of interchangeability which allows utilization of different pulse guns is not available. The ability to interchange pulse guns allows the nut driver to easily be used with a variety of drive devices or pulse guns. Furthermore, the nut driver converts the variety of pulse guns into useful driving tools for fastening nut and bolts or other fastener pairs together.

34 Claims, 4 Drawing Sheets

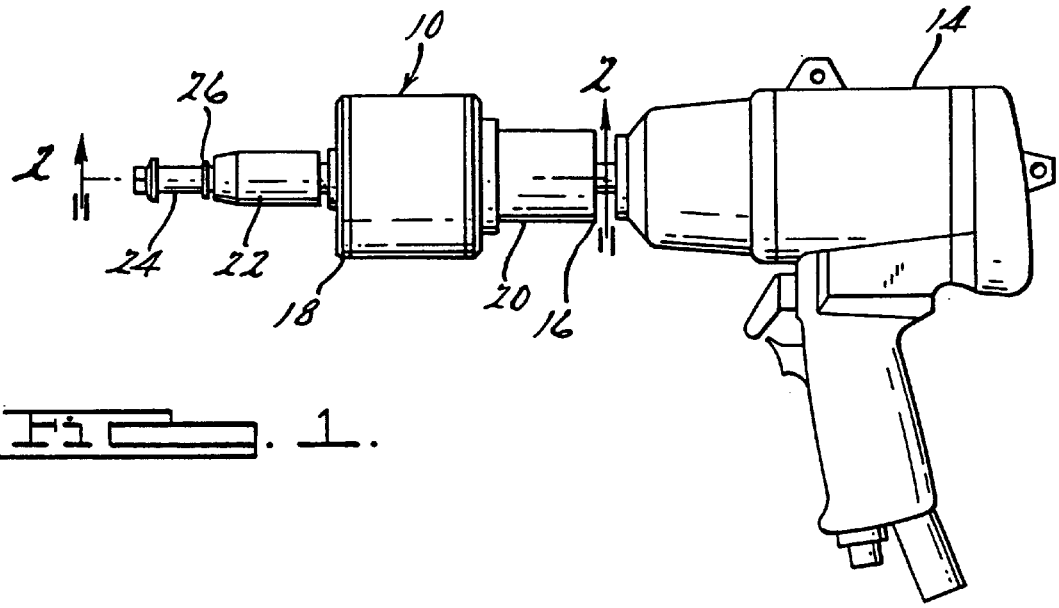
FIG. 1.
FIG. 5.
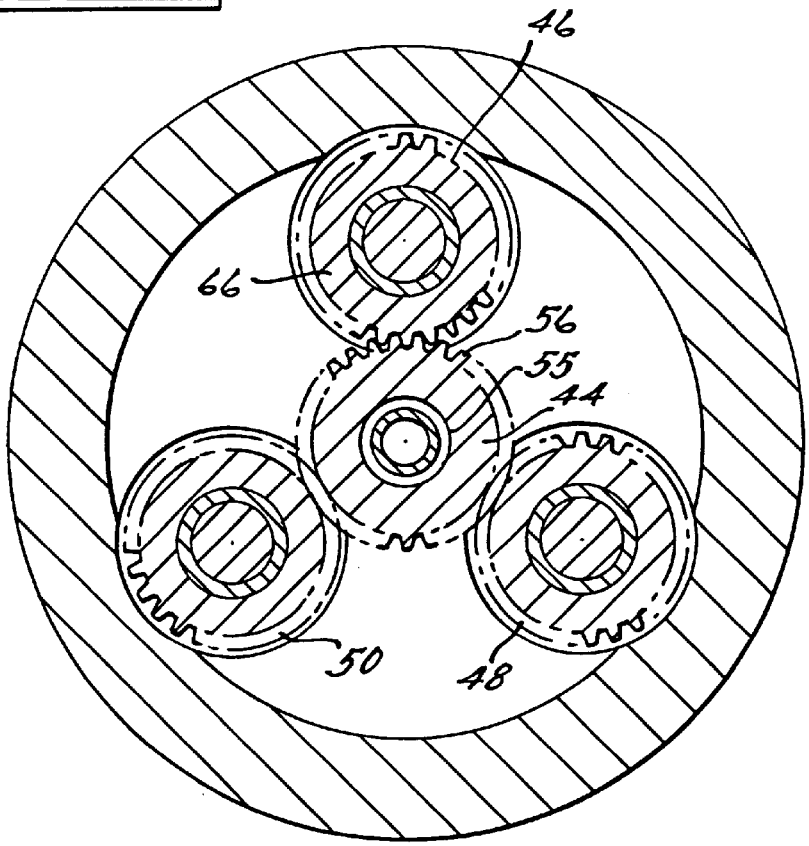

NUT DRIVER

FIELD OF THE INVENTION

The present invention relates generally to a nut driver apparatus and more particularly to a nut driver attachment for use with a pulse gun which provides a drive torque to the attachment.

The tightening of a fastener or nut to a bolt often requires the application of a torque to the fastener while the bolt remains fixed. Drivers in popular use today are often combined as a unitary tool including a motor. Selection of different types of impact wrenches and hammer drills is therefore not possible without substituting the entire unit. Furthermore, conventional nut drivers that are configured for attachment to a drive spindle or power tool are limited in that they are integral with limited types of air impact wrenches and hammer drills. Consequently, there is a need for a nut driver which removably couples to a pulse gun.

Furthermore, traditional drivers often apply a torque to the fastener of a fastener and bolt assembly but do not control the position and movement of the bolt. The bolt is often freely positioned in a hole in which it rests. As a result the bolt may move or the torque may not efficiently tighten the nut to the bolt. This lack of control is detrimental in an environment in which it is desired to quickly tighten the fastener to the bolt. Consequently, there is a need for a nut driver which maintains control of the bolt as well as apply an adequate torque to the nut. Moreover, most conventional torque wrenches and drivers provide an undesirably strong "jerk" or sudden rotational force to the user during use.

SUMMARY OF THE INVENTION

In accordance with the teachings of the present invention, a nut driver is provided. In another aspect of the present invention, a torque is delivered to a fastener while a bolt is rotationally maintained in a fixed position thereby tightening the fastener onto the bolt. Yet another feature of the nut driver is that it removably attaches to pulse gun. In still another aspect of the present invention, the nut driver includes a planetary gear arrangement.

The nut driver allows a smooth rotation of the nut while significantly reducing "jerk-like" motions. The nut driver is also interchangeable with a variety of pulse guns. Although, conventional devices provide a torque to rotationally couple a nut to a bolt, the feature of interchangeability which allows utilization of different pulse guns is not available. The ability to interchange pulse guns allows the nut driver to easily be used with a variety of drive devices or pulse guns. Furthermore, the nut driver converts the variety of pulse guns into useful driving tools for fastening nut and bolts or other fastener pairs together.

Further objects, features and advantages of the invention will become apparent from a consideration of the following description and the appended claims when taken in connection with the accompanying drawings.

BRIEF DESCRIPTION OF THE DRAWINGS

FIG. 1 s a side elevational view showing the preferred embodiment of a nut driver of the present invention attached to a pulse gun;

FIG. 6 is a cross-sectional view, taken along line 6—6 of FIG. 3, showing an output gear and associated idler gears in an engaging arrangement, employed in the preferred embodiment nut driver.

DETAILED DESCRIPTION OF THE PREFERRED EMBODIMENTS

Figure 2:
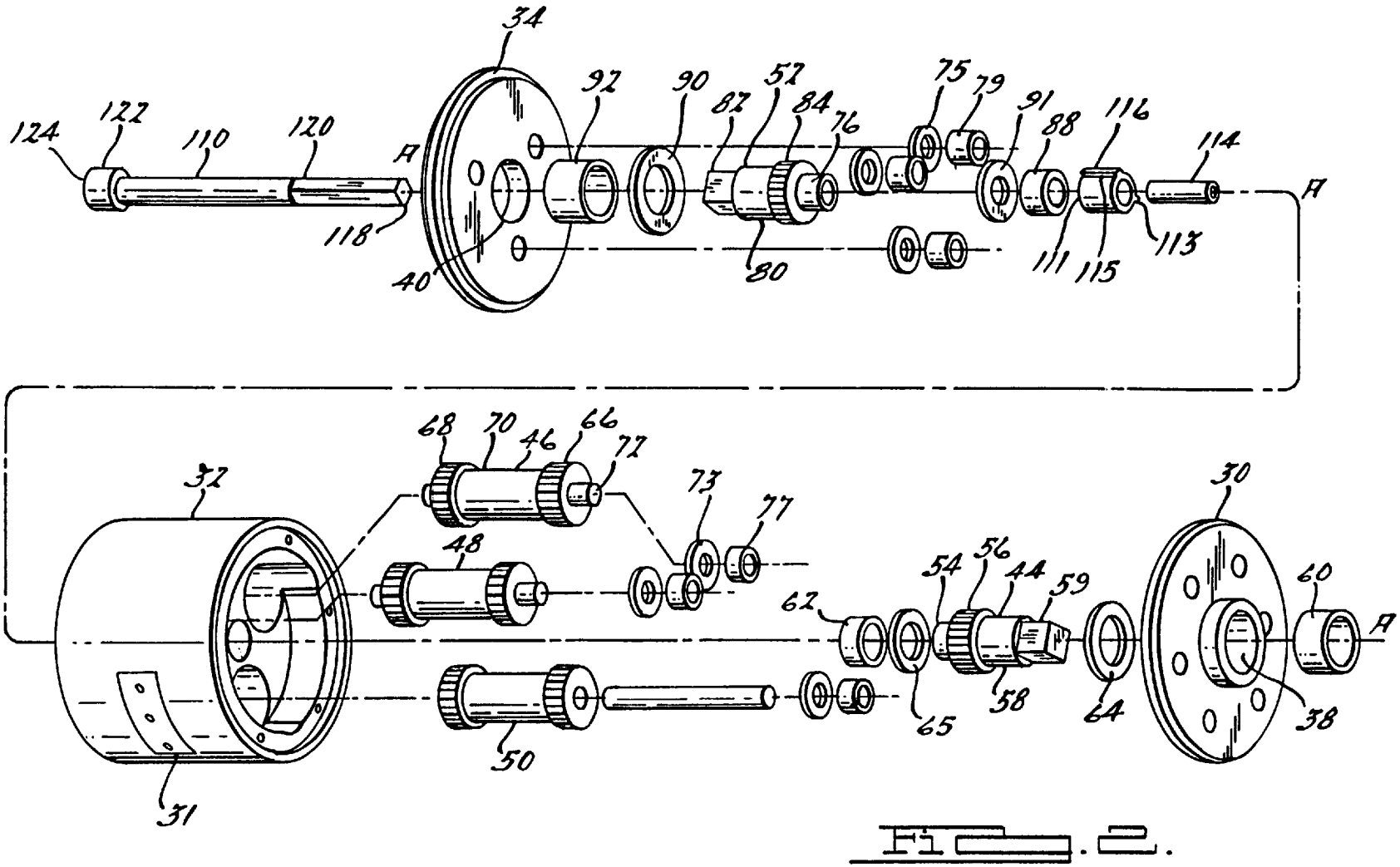
FIG. 2 is an exploded perspective view, taken along line 2—2 of FIG. 1, showing the preferred embodiment nut driver.
Figure 3:
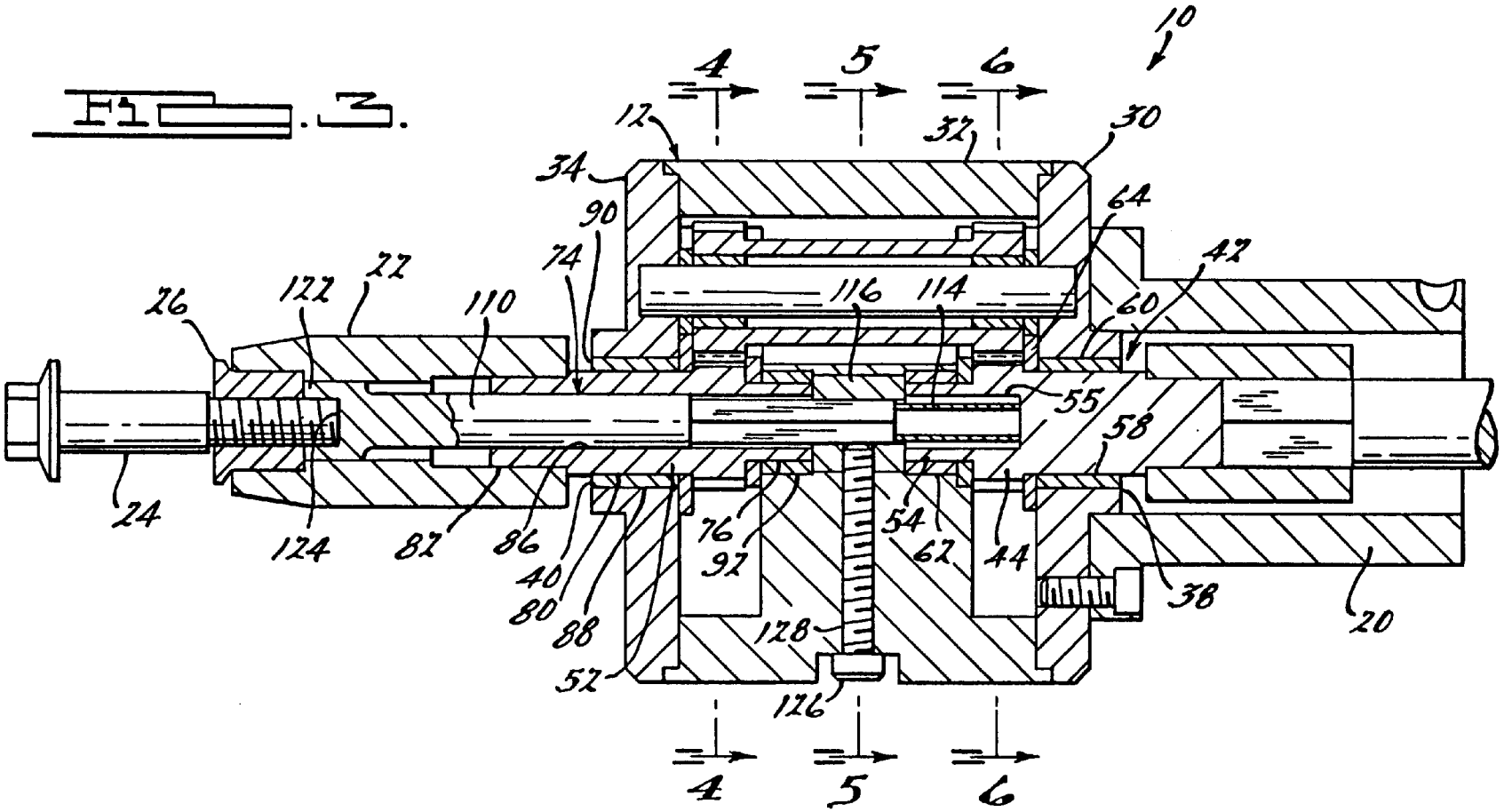
FIG. 3 is a sectional view, taken along line 3—3 of FIG. 2, showing the preferred embodiment nut driver.
Figure 5:
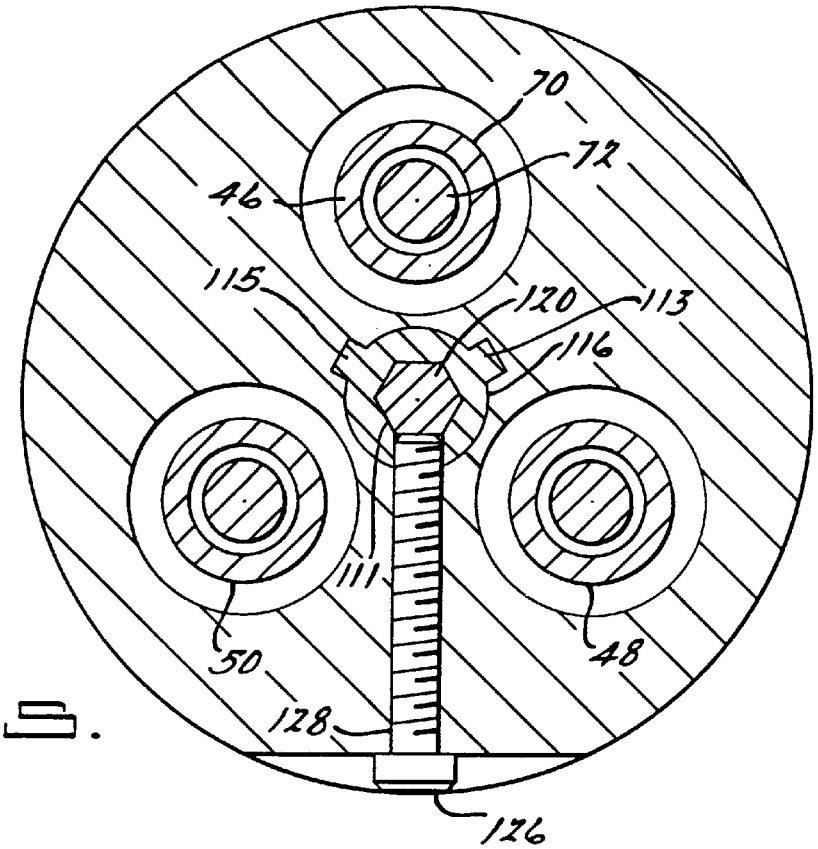
FIG. 5 is a cross-sectional view, taken along line 5—5 of FIG. 3, showing the preferred embodiment nut driver.
Figure 4:
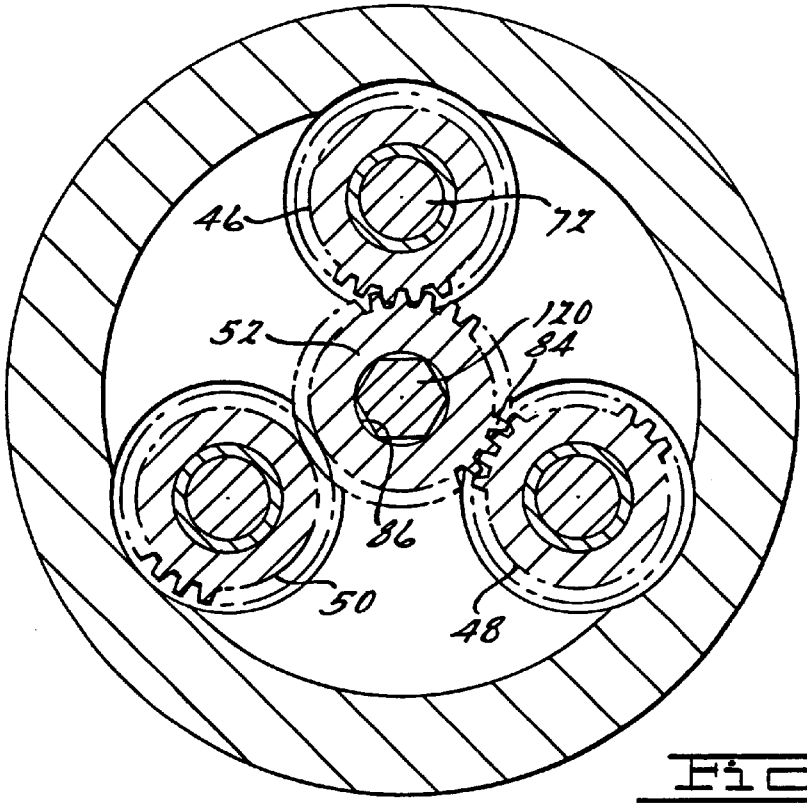
FIG. 4 is a cross-sectional view, taken along line 4—4 of FIG. 3, showing a drive gear and associated idler gears in an engaging arrangement along with a center socket employed in the preferred embodiment nut driver.

Referring to FIGS. 1 and 2, the preferred embodiment of a nut driver apparatus 10 of the present invention is interchangeably coupled to a pulse gun 14 which provides a pulse input torque to nut driver apparatus 10. Nut driver apparatus 10 includes an input end 16 and an output end 18. Input end 16 is coupled to pulse gun 14 via a gun coupler 20. At the opposite end of nut driver apparatus 10, output end 18 is coupled to a nut 26 via socket 22. In this configuration, a threaded bolt 24 is engaged with a threaded nut 26.

FIGS. 2 through 6 show nut driver apparatus 10 in further detail. Nut driver apparatus 10 may be used with any configuration in which it is desirable to torque or forcibly rotate a nut such that it fastens to a bolt. Nut driver apparatus 10 includes a housing 12, gear system 42 and center socket assembly 74. Housing 12 includes an input end cap 30, housing body 32 and output end cap 34. Input end cap 30 and output end cap 34 are coupled to housing body 32. Input end cap 30 and output end cap 34 form input opening 38 and output opening 40, respectively. Input opening 38 and output opening 40 are sized and shaped to rotatably support gears of gear system 42. Housing 12 has a housing adapter 31, for attaching to the pulse gun, but which prevents the housing from rotating.

Gear system 42 is disposed within housing 12. Gear system 42 includes a drive gear 44, idler gears 46, 48,and 50, and an output gear 52. Drive gear 44, idler gears 46, 48 and 50, and output gear 52 form a planetary gear system. Drive gear 44 includes a drive gear outer'shaft 54, drive gear teeth 56, drive gear inner shaft 58 and drive coupling 59. Drive gear outer shaft 54 forms a drive gear channel 55. Drive gear teeth 56 are disposed between drive gear inner shaft 58 and drive gear outer shaft 54. Drive gear teeth 56 engage with two of the idler gears at a time. Drive coupling 59 is coupled to drive gear inner shaft 58. Drive coupling 59 is sized and shaped to couple with the pulse gun in a manner such that drive coupling 59 transmits an input torque to drive gear 44. Needle bearings 60 and 62 are disposed on drive gear inner shaft 58 and drive gear outer shaft 54. Drive gear 44 rotates within housing 12 through needle bearings 60 and 62. Thrust bearing 64 is disposed between drive gear inner shaft 58 and input end cap 30 and thrust bearing 65 is disposed on drive gear outer shaft 54 to permit movement of drive gear 44. Drive gear 44 transfers a pulsating torque to the gear system 42 from the pulse gun 14.

Idler gears 46, 48 and 50 are substantially similar such that idler gear 46 will be described in detail. Idler gear 46 includes input idler gear 66, output idler gear 68, idler gear shaft 70 and idler gear spindle 72. Input idler gear 66 and output idler gear 68 are coupled at a length provided by idler gear shaft 70. Input idler gear 66 and output idler gear 68 are supported on opposite ends of idler gear shaft 70. Idler gear shaft 70 forms a channel within which idler gear spindle 72 is disposed. Idler gear spindle 72 is rotatably supported at a first end within input end cap 30 and at a second end within output end cap 34. Needle bearings 77 and 79 are coupled, at a first location, between input idler gear 66 and idler gear spindle 72 and, at a second location, between output idler gear 68 and idler gear spindle 72. Output idler gear 68 mesh with output gear teeth 84 of output gear 52. When input idler gear 66 selectively meshes with drive gear teeth 56 of drive gear 44, idler gear shaft 70, and thus output idler gear 68 rotates about needle bearings 77 and 79. Thrust bearings 73 and 75 are disposed on either ends of idler gear spindle 72 to assist in distributing force. Idler gears 46, 48 and 50 transfer input drive plower to output gear 52.

Output gear 52 includes an output gear outer shaft 76, output gear teeth 84, input gear inner shaft 80, and output gear coupling 82. Output gear outer shaft 76, input gear inner shaft 80 and output gear coupling 82 form an output gear channel 86. Output gear teeth 84 are supported between output gear inner shaft 80 and output gear outer shaft 76. In the preferred embodiment, output gear teeth 84 engage with two of the idler gears at a time. Output gear coupling 82 is coupled to output gear inner shaft 80. Output gear coupling 82 is sized and shaped to couple with socket 22 in a manner such that output gear coupling 82 provides an output torque to socket 22, and therefore provides torque to nut 26 which fastens onto bolt 24. Needle bearings 92 and 88 are disposed on output gear inner shaft 80 and output gear outer shaft 76. Output gear 52 rotates within housing 12 through needle bearings 88 and 92. Output gear 52 may be rotated in a clockwise or counter clockwise direction. Thrust bearings 90 and 91 are disposed on output gear inner shaft 80 and output gear outer shaft 76, respectively. Output gear teeth 84 selectively mesh with at least two of idler gears 46, 48 and 50. The selective meshing between at least two idler gears 46, 48 and 50 can best be seen in FIGS. 4 and 6.

The arrangement of idler gears 46, 48 and 50 are out-of-line relative to the axis of rotation A, and is desirable because rotation of gear system 42, including output gear 52 (socket 22 and rotated nut 26) via drive gear 44, occurs while the center socket 110 (and supported bolt 24), arranged in-line with the axis of rotation A, remains stationary to maintain the position of the nut 26. Thus, a pulse gun 14 may deliver the appropriate input torque to the gear system 42 for tightening the nut 26, while center socket assembly 74 retains the bolt 24. As a result, the pulse gun 14 can be used to efficiently and quickly fasten bolts and nuts together.

With idler gears 46, 48 and 50 arranged out-of-line with the axis of rotation A about which drive gear 44 and output gear 52 rotate, center socket assembly 74 extends from drive gear 44 to output gear 52 and is positioned in-line with the axis of rotation A. Center socket assembly 74 includes a spring 114, a stem holder guide 116 and a center socket 110. Spring 114 is adjustably supported within stem holder guide 116. Spring 114 provides a reaction force to the center socket 110 if a longitudinal force is applied along the axis of rotation A. This reaction force allows longitudinal movement of the socket during rotating conditions. Spring 114 also is maintained in an extended position when not under a load during tightening of a nut 26. In the preferred embodiment, stem holder guide 116 has two keys 113 and 115 disposed on the outer diameter to prevent rotation when positioned. Holder guide 116 has a multifaceted bore 111 which mates to multifaceted shaft portion 120 of center socket 110. In the preferred embodiment, bore 111 has a hex-shaped cross-section within the housing. Center socket 110 is adjustably supported against spring 114 at a first end 118. First end 118 includes the multifaceted shaft portion 120. In the preferred embodiment, multifaceted shaft portion 120 has a hex-shaped cross-section. Center socket 110 has a length which extends out of housing 12, output end cap 34 and output gear 52. A second end 122 of center socket 110 is formed as a bolt cavity 124 which is sized and shaped to support the end of a standard bolt such that when the fastener associated with a bolt is torqued, bolt cavity 124 seizes the bolt 24, the bolt 24 remains immobile, and thereby allows nut 26 to be tightened onto bolt 24. Multifaceted shaft portion 120 is fixably supported at at least one face by a support pin 126. Support pin 126 fixably rests against one facet of multifaceted shaft portion 120, and is otherwise fixably supported within housing 12 by a channel 128.

Gear system 42 is coupled at the input end to drive coupling 59 which is rotatably supported within gun coupler 20. Gun coupler 20 attaches to a standard pulse drive mechanism, for example, an Acra-Pulse® series pulse gun which can be purchased from AIMCO Corp. of Portland, Oreg. It should be appreciated that any standard pulse gun with an attachment mechanism and which provides a pulsed torque can be used. The benefit, of this interchangeability between standard commercially available pulse guns allows the functional advantages of nut driver apparatus 10 to be available with any existing equipment.

Gear system 42 is further coupled to a socket 22. Output gear coupling 82 of output gear 52 supports socket 22 such that socket 22 rotates in response to the torque output provided by output gear 52. Socket 22 is coupled, at an end opposite of output gear 52, to a nut 26. Accordingly, rotation of nut 26 occurs as socket 22 is rotated or torqued.

Those skilled in the art can now appreciate from the foregoing description that the broad teachings of the present invention can be implemented in a variety of forms. For example, the center socket and socket of the present invention may be formed to torque many different types of fastener pairs. Fastener pairs that are securely coupled by applying a torque may be used by the present invention.

Still further, the gear system of the present invention may be modified to provide the torque output to the socket. For example, a planetary gear system with more than three gears can be used to deliver an output torque. Additionally, the present invention may be integrally formed with a pulse gun to provide a one-unit piece. Therefore, while this invention has been described in connection with particular examples thereof, the true scope of the invention should not be so limited since other modifications will become apparent to the skilled practitioner upon studying of the drawings, specification, and the following claims:

What is claimed is:

1. An apparatus for rotating a fastener, the apparatus comprising:

a housing having a cavity;

a gear system operably transmitting an output torque, the gear system having a drive gear, a plurality of idler gears, and an output gear, wherein the drive gear and the output gear are positioned to rotate about a common central axis and the idler gears are each positioned to rotate about idler gear axes displaced from the common central axis, the output gear having an output gear channel, the drive gear having a drive gear channel; and a socket assembly including a center fastener-receiving socket and a fitting operably deterring the center socket from rotational movement, the fitting being stationarily supported within the housing and along the central axis, the fitting including a channel and a support pin, the fitting channel retaining the support pin such that the support pin abuts a shaft portion of the center socket, and the support pin operably preventing substantial rotation of the center socket, the center socket being located at least partially in the output gear channel;

wherein the drive gear, idler gears and output gear are rotatable while the center socket remains in a fixed rotational position.

2. The apparatus of claim 1 wherein the center socket has a first end and a second end, the first end is a shaft and the second end forms a bolt-receiving cavity.

3. The apparatus of claim 2 wherein the shaft is multifaceted.

4. The apparatus of claim 1 further comprising a pulse gun with an output shaft, and the drive gear being removably attachable to the output shaft.

5. The apparatus of claim 1 further comprising a pulse gun coupler fixably connected to the housing.

6. The apparatus of claim 1 further including a socket coupled to the output gear, the socket rotationally responsive to the movement of the output gear.

7. The apparatus of claim 1 further comprising a spring having a first end and a second end, the first end supported within the drive gear channel and the second end abutting the center socket.

8. The apparatus of claim 1 wherein the idler gears are supported on idler gear shafts and the gear system is a planetary gear system.

9. The apparatus of claim 6 wherein the socket and housing are coaxial.

10. An apparatus for providing an output torque, the apparatus comprising:

a planetary gear system operably transmitting output torque to a first threaded fastener;

an outer socket having a first end and a second end, the first end being coupled to the planetary gear system and the second end being configured to be coupled to the first threaded fastener; and an inner socket coaxially mounted inside the outer socket;

wherein the inner socket is configured to operably engage a second threaded fastener that is complementary to the first threaded fastener to maintain a fixed orientation of the second threaded fastener and the outer socket operably provides a rotational torque to the first threaded fastener thereby tightening the first threaded fastener and second threaded fastener together; and wherein the planetary gear system has a drive gear that rotates about a center axis of rotation and has a channel and further including a spring having a first end and a second end, the first end is supported within the drive gear channel and the second end abuts the inner socket such that the spring provides a reaction force to the inner socket in response to an opposite force applied to the inner socket along direction of the center axis of rotation.

11. The apparatus of claim 10 wherein the inner socket having a first end and a second end, the first end is a shaft portion and the second end forming a fastener cavity operably retaining the second fastener during rotation.

12. The apparatus of claim 11 wherein the shaft portion is multifaceted.

13. The apparatus of claim 10 wherein the planetary gear system includes a plurality of idler gears that are each disposed on and rotate about an idler gear spindle and needle bearings are disposed on each of the idler gear spindles.

14. The apparatus of claim 13 wherein the planetary gear system includes a drive gear on a drive gear shaft and an output gear on an output gear shaft and needle bearings are disposed on said drive gear shaft and said output gear shaft.

15. The apparatus of claim 10 wherein the planetary gear system has a drive gear that can be removably coupled to a pulse gun output shaft.

16. The apparatus of claim 10 further including a housing having activity in which the planetary gear system resides and a gun coupler fixably connected to the housing.

17. The apparatus of claim 10 further including a fitting having a fitting channel and a support pin, the fitting channel is sized and shaped to retain the support pin such that the support pin adjustably abuts a shaft portion of the inner socket, the support pin operably prevents substantial rotation of the inner socket.

18. A system for rotating a first threaded fastener which couples to a second threaded fastener, the system comprising:

(a) a set of pulse guns;

(b) a nut driver attachment including:

(i) a housing operably forming a cavity, the housing having a gun coupler operably attaching to one of the set of pulse guns, the gun coupler being interchangeably operably attachable to each pulse gun of the set of pulse guns;

(ii) a planetary gear system operably transmitting an output torque, the planetary gear system having an output gear;

(iii) a socket operably applying the output torque to the first fastener, the socket being coupled to the output gear;

(iv) a center socket being substantially coaxial with the output gear, the center socket being rotationally fixed and supported by the housing; and (v) a fitting disposed in the housing and having a fitting channel and a support pin, the fitting channel being sized and shaped to retain the support pin such that the support pin adjustably abuts a shaft portion of the center socket, the support pin operably preventing substantial rotation of the center socket;

wherein the center socket is operably coupled to the second threaded fastener to maintain a fixed orientation of the second threaded fastener and the socket is operably coupled to the first threaded fastener to provide a torque thereby fastening the threaded fasteners together.

19. The system of claim 18 wherein the output gear includes an output gear channel, the output gear channel extends longitudinally throughout the output gear such that the center socket is disposed within the output gear channel and maintains a rotationally fixed position while the output gear rotates.

20. The system of claim 19 wherein the planetary gear system has a drive gear and the drive gear forms a drive gear channel.

21. The system of claim 20 further including a spring, the spring disposed within the drive gear channel, the spring abutting a first end of the center socket such that the drive gear rotates while the center socket maintains a rotationally fixed position.

22. The system of claim 18 wherein the center socket having a first end and a second end, the first end is a shaft portion and the second end forming a cavity operably retaining the second threaded fastener during rotation.

23. The system of claim 22 wherein the shaft portion is multifaceted.

24. The system of claim 18 wherein the planetary gear system has a plurality of idler gears that are each disposed on and rotate about an idler gear spindle, each idler gear spindle having a pair of needle bearings disposed thereon.

25. The system of claim 18 wherein the gear system includes a drive gear and a plurality of idler gears disposed within the housing, the drive gear having an outer drive gear shaft and the output gear having an outer output gear shaft, the outer drive gear shaft and the outer output gear shaft defining a center axis of rotation, the plurality of idler gears coupled between the drive gear and the output gear, each of the plurality of idler gears rotationally supported on planetary gear spindles, wherein the plurality of idler gear spindles are displaced from the center axis of rotation.

26. The system of claim 25 further including a fitting positioned on the center axis of rotation, the fitting fixably supported by the housing and along the center axis of rotation, the fitting disposed between the drive gear and the output gear.

27. The system of claim 18 wherein the center socket is disposed within an output gear channel.

28. The system of claim 18 wherein the socket has a first end and a second end, the first end coupled to the output gear and the second end coupled to the first threaded fastener.

29. The system of claim 25 wherein the plurality of idler gears includes a first idler gear, a second idler gear and a third idler gear.

30. The system of claim 25 wherein at least two of the plurality of idler gears selectively engage with the drive gear and the output gear.

31. The system of claim 18 wherein the planetary gear system has a drive gear that can be removably coupled to an output shaft of a pulse gun of the set of pulse guns.

32. The system of claim 18 wherein the gun coupler is fixably connected to the housing.

33. The system of claim 18 wherein the planetary gear system has a drive gear that together with the output gear define a center axis of rotation and further includes a spring having a first end and a second end, the first end supported within a channel in the drive gear and the second end abutting the center socket such that the spring provides a reaction force to the center socket in response to an opposite force applied to the center socket along direction of the center axis of rotation.

34. The system of claim 18 wherein the housing includes an adapter operably preventing the housing from rotating.

* * * * *